United States Patent [19]

Schlachter

[11] Patent Number: 4,737,180

[45] Date of Patent: Apr. 12, 1988

[54] PROCESS AND MECHANISM FOR THE PRODUCTION OF GLASS FIBER PRODUCTS FOR EXAMPLE FLEECES, MATS, YARNS AND ROVINGS

[75] Inventor: Fredo E. L. Schlachter, Johannesberg, Fed. Rep. of Germany

[73] Assignee: Glaswerk Schuller GmbH, Fed. Rep. of Germany

[21] Appl. No.: 866,028

[22] Filed: May 21, 1986

[30] Foreign Application Priority Data

May 24, 1985 [DE] Fed. Rep. of Germany ..... 3518769

[51] Int. Cl.[4] ..... C03B 37/035

[52] U.S. Cl. ..... 65/4.4; 65/9

[58] Field of Search ..... 65/1, 2, 10.1, 11.1, 65/4.4, 9

[56] References Cited

U.S. PATENT DOCUMENTS

| | | | |
|---|---|---|---|
| 2,586,774 | 2/1952 | Bastian et al. | 65/9 |
| 2,996,102 | 8/1961 | Schuller | 65/9 X |
| 3,019,078 | 1/1962 | Roberson | 65/1 X |
| 3,076,236 | 2/1963 | Labino | 65/9 |
| 3,442,751 | 5/1969 | Langlois | 65/11.1 X |
| 3,676,096 | 7/1972 | Schuller et al. | 65/11.1 X |
| 3,883,333 | 5/1975 | Ackley | 65/2 |
| 3,900,302 | 8/1975 | Langlois et al. | 65/2 X |
| 4,175,939 | 11/1979 | Nakazawa et al. | 65/2 |

*Primary Examiner*—Robert L. Lindsay

*Attorney, Agent, or Firm*—John D. Lister; Cornelius P. Quinn; Timothy R. Schulte

[57] ABSTRACT

A process and apparatus for the production of glass fiber is disclosed. The process and apparatus are directed to collecting filaments being drawn from streams of liquid glass into a plurality of loosely bound strands of filaments which additionally are not treated with any binders. The strands are then drawn off individually on separated but parallel rotating surfaces to provide the filaments with a desired diameter.

10 Claims, 2 Drawing Sheets

FIG. 1.
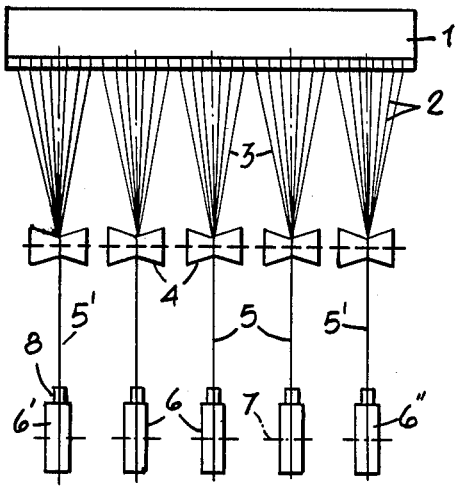
FIG. 2.
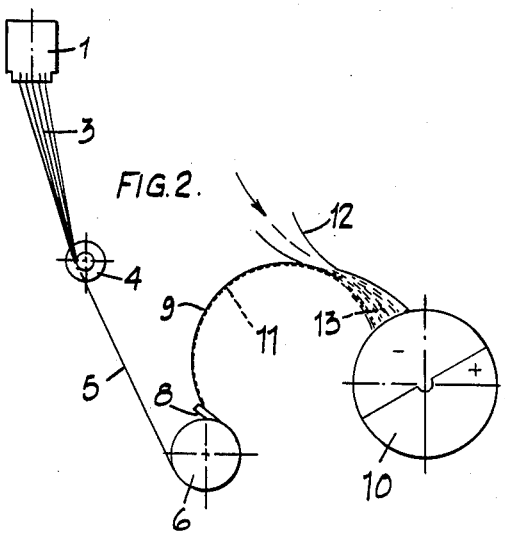
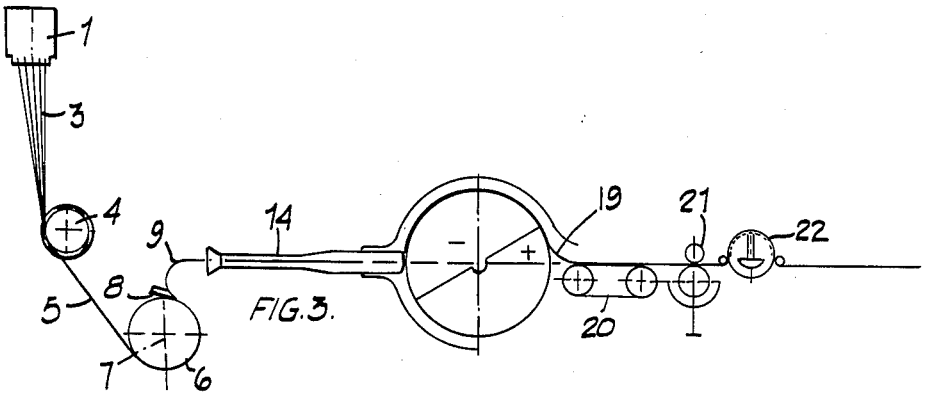
FIG. 3.
FIG. 4.
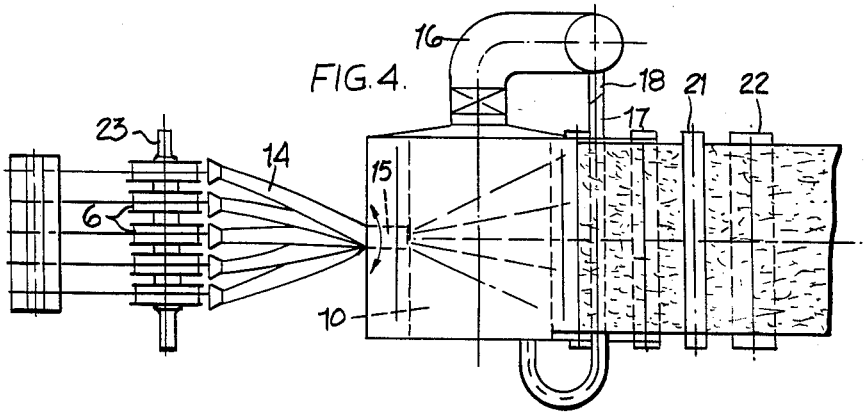

PROCESS AND MECHANISM FOR THE PRODUCTION OF GLASS FIBER PRODUCTS FOR EXAMPLE FLEECES, MATS, YARNS AND ROVINGS

The invention relates to the production of glass strands from glass filaments (threads) and their processing into flat web bodies, such as for example fleeces and mats or strand shaped bodies like rovings and yarns wherein the filaments are drawn off from a supply of liquid glass mass streams emerging as glass filaments and are subsequently divided into strands.

BACKGROUND OF THE INVENTION

Many different methods have been proposed, tested and applied for drawing off filaments (thread). Among the other methods are air and vapor streams (jets), ejectors placed transversely to the direction of emerging filaments and centrifuging disks. It is important to draw the filaments safely such that they have a relatively constant diameter before their distribution into fibers. The drum-draw-off process was proven to be the safest in which the filaments drawn from nozzles of a nozzle bushing containing the liquid glass run upon a drawing drum and from this are carried along over a portion of its circumference and are lifted before a reaching a single turn and are distributed into a staple fiber. It is possible to set and maintain the peripheral velocity according to a precise ratio of the diameter and r.p.m. of the drum which enables maintenance of a determined diameter of the filament within very narrow tolerances. For many years, diameters of drums of 1000 mm and lengths of drums of 1000 mm, as well as draw-off speed of about 50 m/sec have been conventionally adopted. When the drawn-off filaments are removed from the drum (lifted) by a shedder (stripping device) before the termination of a sole circle around, divided into fibers, which are then guided by a deflection to a conveyor belt and led through it by a circulatory draft created by rotation of the drum, the process is designated as a "dry process", which is contrary to a "wet process" in which the glass threads cut into bundles of an equal but relative short length, suspended in water, are filtered out so as to form fleece on a forming wire. The advantage of the wet process and the reason for its increased application, compared to the dry process, lies in its high productivity. This consists, among others, in that in this process, at an other point, glass strands are produced in large amounts, for example by winding on drawing drums the wound up portions are removed as "fleece" and cut into fibers which can then be poured into water tubs (tanks) (U.S. Pat. No. 3,766,003). However, the market also requires fleeces having greater fiber length since these do not need such a strong binder which also leads to softer and more flexible fleeces.

Problems arise in the dry process. Among others, exact revolution of the heavy drum requires precise drum seating which means that the surface of the drum must be kept painfully, clean and smooth. Despite such problems with the drum, the biggest problem lies with the shedder (stripper). German Pat. No. 1,285,114 describes the problems connected with application of a shedder. The departure from previously used thick scrapers and the turning to extremely thin elastic shedders, amounted at the time to great progress. Problems connected with shedders are of an alternating effect with those of the draw-off or spinning drum, in addition with those caused by the so called "condensation of threads" problem which condensation has increased enormously during the last ten years. This dramatic increase has made it more diffcult, in effect, overloading the draw-off method of the drum. It originally started with 100 to 150 filaments produced by melting-off from the ends of in a series of arranged rods, drawn-off by a 1000 mm wide drum and lifted from it. Today we have arrived to 500 and more nozzle equipped bushings. This means that the same micron thick threads (filaments) lie together more tightly on the same width of drum, namely less than 1 mm today in comparison to about 1 cm before. As a result, guiding on the surface of the drum must be more precise and the filaments must not be laterally shifted during their partial winding around. In addition, the shedder must simultaneously safely lift and lead more filaments now. The surface of the drum must also be completely smooth, since grooves and channels are more damaging in that a smaller number of threads will ascend. This again means that the shedders must be replaced more often and the durms cleaned and replaced more often. The shedders (strippers), which not only have the task of lifting or removing the filaments from the surface of the drum but also deflecting the rotary draft created by rotation of the drum and transporting the formed filaments, must be applied only by a light pressure or without pressure against the surface of the drum, otherwise a substantial frictional heat will be created that stresses especially the edge of the shedder, necessitating its repointing and replacement more often.

The problems connected with increased density of the threads on the shedder set mechanical limits on economical glass fleece production. Also to a great extent, the changing deposits in the dry fleece installations, according to the German Pat. Nos. 976,682 and 1,270,456, working according to the drum process are worldwide proven and accepted, so that a stronger process has prevailed, similar to that used in the paper industry, the so called wet process. According to U.S. Pat. No. 3,766,003, problems connected with the removal of large numbers of filaments from the periphery of the drum arise when trying to run the filaments layerwise on the drawing drum and separate them as fleece only after obtaining a certain thickness of layer along a coat line of the drawing drum.

Accordingly, a task of the invention lies in being able to exploit the progress of the increased filament or thread density in the dry process and eliminate the problems connected with shedders or at least considerably reduce their significance, for example, by reducing system downtime associated with shedder problems.

It is known to collect into a filaments emerging from the nozzles of a muffle containing liquid glassinto strands, to cut the strand into pieces of equal length and to deposit the thus formed chopped strands as so called "chopped strand mat" on a forming wire. For this purpose it is necessary to provide the individual filaments with a binder, which filaments converge into a strand already very early on their way from their formation on the outlet of the nozzle until they are deposited, which takes care of their mutual cohesion in the strand. For example, British Pat. No. 785,935 describes a method in which individual filaments are led to a disk collecting them in a strand and notched on its periphery, after they have previously been sprayed in the so called "filament harp" by a binder. The filaments arrive about vertically from above into the coat notch of the disk and leave this disk horizontally as a strand, passing thus about 90° of the disk forming the strand. The strand is removed from this disk by several subsequently placed ejectors which have to extend the individual filaments connected into a strand and draw it, in spite of the already sprayed on binder, to the desired diameter. Between two ejectors is a cutting mechanism which divides the strand into cuttings, and the last ejector brings and deposits these finally on a sieve wall. According to U.S. Pat. No. 3,318,746, it is known to collect the filaments with the help of several mutually distanced, notched rollers into strands so as to provide them with a binder just before they run through the first roller into about a six strands forming roller. After the second roller, the strands arrive over a stretching roller on the drawing disk which can apply then only a drawing-off effect on the strands and not extending drawing effect on the individual filaments, i.e. cannot draft them to a desired and a different diameter before they emerge from the muffle. From this drawing disk, the strands are lifted always as a whole unit forming a loop-shaped throw-off on a conveyor bank placed below the disk and lifted by a spoke wheel that reaches with its spokes through openings in the surface of the casing. On the other hand, in the dry process, the improvement of which is the purpose of the invention, the loose filaments not having been treated with binder are grouped into strands of collected filaments and drawn to the desired diameter by a rotating drawing surface and subsequently separated into individual fibers which are collected with circulating draft produced by the rotating surface.

SUMMARY OF THE INVENTION

The invention relates to a process and apparatus for the production of glass fiber products, for example fleeces and yarns, in which a number of filaments (threads) is drawn off from streams of liquid glass by a rotating surface, drawn to the desired diameter and lifted (removed) before completing a single lap, divided in this operation into individual fibers and led by the draft caused by rotation over a deflection as fiber-air current to a further processing mechanism. The "concentration of filaments" has made great progress in the last years because of the success of placing 1500 and more nozzles into a nozzle bushing that melts the glass and leads to the nozzles at practically the same size starting from originally 100 to 150 spin-off points. With this progress it became difficult to keep pace with drawing off filaments and with removing (lifting) filaments with a single shedder (stripper). This difficulty is solved by the present invention wherein the filaments are collected loosely and without a binder into groups to form strands of filaments which are then individually drawn off in parallel on separated but parallel rotating surfaces, each strand being assigned to one rotating surface and each surface being provided with at least one shedder.

BRIEF DESCRIPTION OF THE DRAWINGS

Examples of embodiment for realizing the invention in practice are schematically illustrated in the drawings and described in the following. They represent in FIG. 1 the diagram of production of fibers according to the invention in front view and in a considerably reduced scale;

FIG. 2 the diagram of FIG. 1 in sideview;

FIG. 3 a mechanism according to the invention for the production of a fiber fleece or of a fiber mat in sideview;

FIG. 4 the mechanism of FIG. 3 in top view;

DETAILED DESCRIPTION OF THE DRAWINGS

Figure 5:
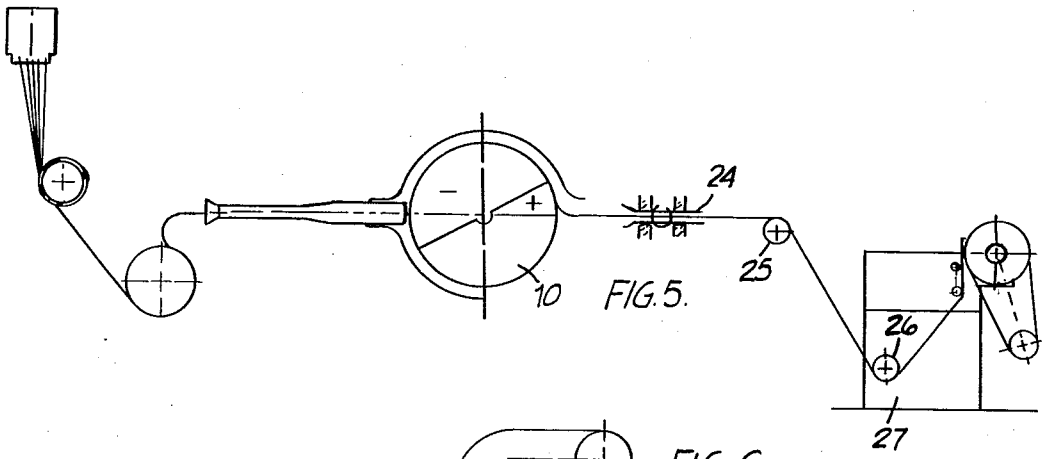
FIG. 5 schematically a mechanism according to the invention for the production of rovings or yarns in sideview.

FIGS. 1 and 2 illustrate a nozzle body marked by 1 which represents all possible mechanisms for producing filaments from the nozzles embedded in its bottom. Glass filaments 2 which are drawn simultaneously in great numbers from body 1 are subdivided in groups 3 by strand formers 4, for example, notched guide rollers which in turn form the filament group 3 into strands 5, each of which runs up to the rear side of a draw-off disk 6 having a smooth surface. The draw-off disks 6 share as illustrated in FIG. 1 a mutual axis 7. Before a complete rotation of disks 6 is completed, strands 5 are lifted by a shedder (stripper) 8 from the periphery of the disk and led over a guiding mechanism 9 to a screening drum 10. In addition to notched rollers; eyelets, forks or similar devices can serve as strand formers 4.

Since filaments 2, collected into groups 3, are loose in the strands and connected without binder, some of them are split off into single filaments of different lengths during their removal by shedder 8. This happens even though all of the filaments are safely drawn equally by the draw-off disks to the required diameter. A blow-apart mechanism 12, built into a filament-fiber flight 11 separates the strands into fibers 13 shortly before the fibers are deposited on the sieve collection drum 10. The blow-apart mechanism 12, for example, an ejector, can also reinforce the air current produced by rotation of the disks 6 and transportion of the fibers and the filaments 11 in the guided path 9. During this operation, it is also possible to simultaneously introduce a reagent, for example, a binder and/or an antistatic. The screening drum 10 is subdivided into a suction zone (−) and a positive pressure zone (+). While the suction zone conveys the fleece forming fiber deposit, the positive pressure zone assists in the removal of the fleece layer.

By distributing the filaments into groups, the loose collection into strands and their drawing off by one disk assigned to each strand arranged with the other disks in one common axis or with a common plane of the run-up points of the strands, it is possible to simultaneously process a great number of filaments (for example 1500 and more). Since now shedders of a short length can be controlled more easily than those of a great length, i.e., their entire surface can be uniformly applied over the total width of a narrow drawing off disk, the smaller drawing off surfaces can be kept clean easier, and if their surfaces become worn they can be easily replaced.

It must be mentioned that FIGS. 1 and 2 only schematically represent the principle of the invention and that for reasons of a simplified diagrammatic illustration, only five groups 3, strands 5, drawing off disks 6 with their shedders are illustrated. In fact, many more drawing off disks, for example about 15, can be placed on the standard width of 1000 mm which has proven to be satisfactory, i.e., by dividing, for example, 1500 individual filaments into 15 groups each of 100 filaments.

With respect to fiber fleece or mat production represented schematically in FIGS. 3 and 4, the strands 5 of filaments arrive after having been drawn off by drawing off disks 6 and removed by shedders 8, for the most part already as fibers, over a guiding mechanism 9 into venturi tubes 14, in which the as yet undistributed filaments are divided into fibers. The tubes 14 open into a depositing nozzle 15 that moves oscillatingly or changingly over the width of a screening drum 10 and deposits the fibers on it. An emerging air channel 16 is flanged to the screening drum 10 that creates a suction zone (−) at underpressure (partial vacuum) within the drum. In addition, a branch tube 17 creates a positive pressure (+) zone in drum 10, the pressure of which can be adjusted by means of a throttle valve 18. The fleece or mat shaped fiber layer 19 is lifted off the positive pressure zone, placed on a conveyor 20, and conveyed to an applicator mechanism 21 which treats the layer 19 with binders. The fiber layer can also be coated or impregnated.

Figure 6:
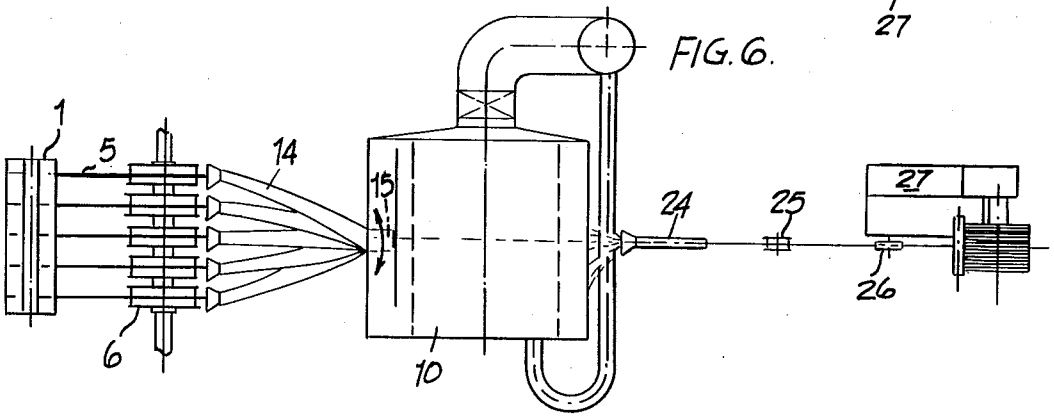
FIG. 6 a mechanism according to FIG. 5 in top view.

FIGS. 5 and 6 schematically illustrate application of the principle of the invention in the production of strands, rovings or yarns. The production of a layer of fibers on a screening drum 10 takes place as such took place in fleece or mat production. However, this layer of fibers is not removed as a flat web in the zone of positive pressure but runs collected as a strand into a twisting tube 24 in which the fibers are closed into a roving or yarn and then to a reeling up mechanism in a known manner over guiding and stretching rollers 25, 26. In the production of yarns and especially rovings, the screening drum can be omitted and the twisting tube can be attached directly to socket 15.

The example for fleece or mat production according to FIGS. 3 and 4, and yarn production according to FIGS. 5 and 6 show only two possible uses of the present invention. It is also possible according to FIGS. 1 and 2 to bring the formed fibers directly through the drawing disk 6 over a deflecting device 9 to a surface of deposition, for example a screening drum. In this operation, band shaped fiber deposits will be formed on the surface of deposition by the individual drawing disks, which deposits form mutually overlaping one fleece. In this case, some of the disks 6 which are normally driven by a common shaft 23 at the same speed of rotation and consequently at the same circumferential speed as the other disks 6, are driven at a different rotational speed than the remaining disks. As a result, different diameter filaments result. It is thus possible to run, for example, the two outer drawing disks 6' and 6'' slower than the remaining disks 6, which makes the filaments 2 of the respective group 3 of filaments of both these outer disks. These coarser filaments can be used to reinforce the marginal portions of a formed fleece. Thus, just because drawing disks 6 lie on a common axis, this does not mean that they have to be driven at the same speed by one shaft.

The same effect can be achieved by using disks having different diameters at identical speeds of rotation. In this case it is possible to start with a shaft that is common to all drawing disks and arrange it so that all of them form a common runup plane for the strands.

Another possibility would be to collect a variable number of filaments 2 into one group 3 whereby the amount of fibers delivered by the drawing disk becomes greater than that delivered by another disk. Thus, for the aforementioned reinforcement of the marginal portions of a fiber fleece it would be possible to provide strands 5' and 5'' with more filaments than the remaining strands 5 and thus direct more fibers to outer disks 6' and 6''. The slight differences of thickness in the deposited layer of fibers can be essentially eliminated on the formed fleece by passing the layer through a pair of rollers.

While specific embodiments of the invention have been shown and described in detail to illustrate application of the invention's principles, it will be understood that the invention may be embodied otherwise without departing from such principles.

What is claimed is:

1. In a process for the production of glass fiber which includes drawing a number of filaments from streams of liquid glass using a rotary surface to draw the filaments to a desired diameter, and before completion of a single rotation, removing the filaments from the rotating surface, an improvement comprising collecting the filaments being drawn from streams of liquid glass into a plurality of loosely bound strands of filaments prior to being treated with binders and then drawing off the strands individually on separated but parallel rotating surfaces, said surfaces being solid and smooth.

2. Process according to claim 1, wherein the surfaces rotate at different speeds.

3. Process according to claim 1, wherein the strands of filaments contain different numbers of threads.

4. In an apparatus for the production of glass fiber which includes means for simultaneously producing numerous thin streams of liquid glass and means using rotating surfaces for drawing off streams of glass into filaments having a desired diameter, and means for removing the filaments from the rotating surface before completion of a single rotation, an improvement comprising means for collecting the filaments being drawn from streams of liquid glass into a plurality of loosely bound strands of filaments and means for individually drawing off the strands on separated but parallel rotating surfaces, each strand being drawn off by a separate smooth and solid rotating surface prior to being treated with a binder.

5. An apparatus according to claim 4, further comprising means for rotating the surfaces at different speeds.

6. An apparatus according to claim 4 wherein the means for collecting provides strands containing different numbers of threads.

7. An apparatus according to claim 4 further comprising blowing apart means connected to the end of a revolving means that distributes nondecomposing threads into fibers, said revolving means receiving said filaments having been removed from the rotating surface.

8. An apparatus according to claim 7 wherein the blowing apart means is designed as a depositing mechanism.

9. An apparatus according to claim 8 wherein the depositing device comprises a bundle of pipes each being assigned to a separate individual drawing means, said pipes opening jointly at their opposite ends, said joint opening moving changingly or oscillatingly over the width of a depositing surface.

10. An apparatus according to claim 4 wherein the collecting means comprise rollers with an annular notch or groove in the surface of a casing.

* * * * *